United States Patent [19]

DeForrest, Sr.

[11] Patent Number: 4,877,275

[45] Date of Patent: Oct. 31, 1989

[54] PROTECTED SLIDING BOLT LOCKING STRUCTURE

[76] Inventor: William DeForrest, Sr., 1825 Via Burton, Anaheim, Calif. 92806

[21] Appl. No.: 145,507

[22] Filed: Jan. 19, 1988

[51] Int. Cl.[4] ..... E05B 67/02

[52] U.S. Cl. ..... 292/148; 292/162; 292/244; 70/56; 70/129

[58] Field of Search ..... 292/148, 145, 162, 156, 292/244; 70/54–56, 129, 416–417

[56] References Cited

U.S. PATENT DOCUMENTS

| | | | |
|---|---|---|---|
| 1,774,330 | 8/1930 | Kaser | 292/162 X |
| 2,037,309 | 4/1936 | Brown | 292/145 X |
| 2,482,341 | 9/1949 | Holmsten | 292/148 |
| 3,374,020 | 3/1968 | Berg | 292/148 X |
| 3,451,703 | 6/1969 | Roegner | 292/148 |
| 3,697,106 | 10/1972 | Meyer | 292/162 X |
| 3,752,518 | 8/1973 | Cannell | 292/148 X |
| 3,953,062 | 4/1976 | Maston | 292/57 |
| 4,021,063 | 5/1977 | Porter | 292/148 X |
| 4,031,719 | 6/1977 | Klingler et al. | 70/56 |
| 4,068,505 | 1/1978 | Volk, Jr. | 292/148 X |
| 4,229,956 | 10/1980 | Thorburn | 292/148 X |
| 4,322,102 | 3/1982 | Lindblom | 292/148 X |
| 4,372,138 | 2/1983 | De Forrest | 70/56 |
| 4,512,105 | 4/1985 | Norton | 292/148 X |
| 4,573,722 | 4/1986 | Lyng | 292/148 |
| 4,655,487 | 4/1987 | Korn et al. | 70/56 X |
| 4,690,441 | 9/1987 | Fazzolari et al. | 70/417 X |
| 4,782,675 | 11/1988 | Thorburn | 292/148 X |

FOREIGN PATENT DOCUMENTS

| | | | |
|---|---|---|---|
| 364731 | 1/1932 | United Kingdom | 292/162 |

*Primary Examiner*—Gary L. Smith
*Assistant Examiner*—Michael J. Milano
*Attorney, Agent, or Firm*—Herb Boswell

[57] ABSTRACT

A sliding bolt locking structure has a housing which includes a back and right and left sides integrally formed with the back. A guide element is located on the housing between the sides. The guide element includes right and left side shackle holes for receiving the shackle of a lock. A member having right and left side panels is sized and shaped to fit in the housing between the respective sides of the housing. The left and right side panels of the member are spaced apart from one another a distance sufficient to allow positioning of a lock body between these respective side panels. The member includes a guide channel located in the side panels which fits over and slides on the guide element. The member slides on the guide element to position the shackle holes between the side panels of the member allowing for passing of a lock shackle through one of the lock shackle holes when the member is positioned with respect to the lock shackle hole. Bolt holes are formed in the respective sides of the housing. A bolt is fixed to the member to move with the member. The bolt is sized and shaped to project through the bolt holes in the sides of the housing and to be movable in these bolt holes between extended and retracted positions in response to movement of the member on the guide element.

18 Claims, 1 Drawing Sheet

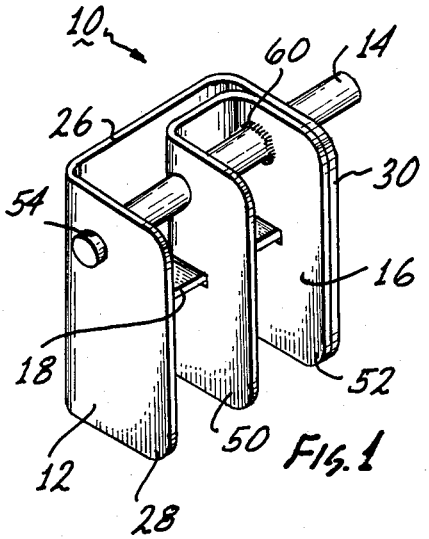
FIG. 1
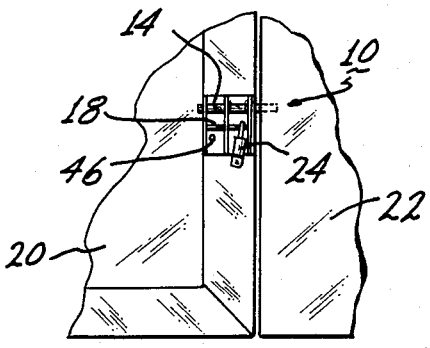
FIG. 2
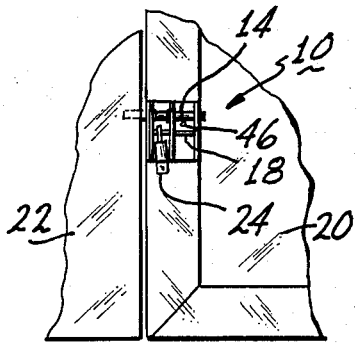
FIG. 3
FIG. 4
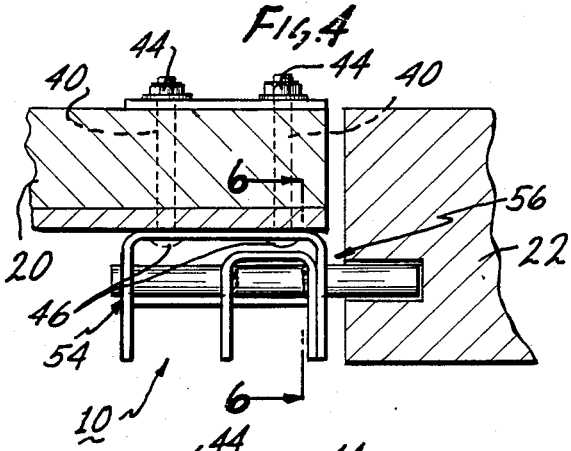
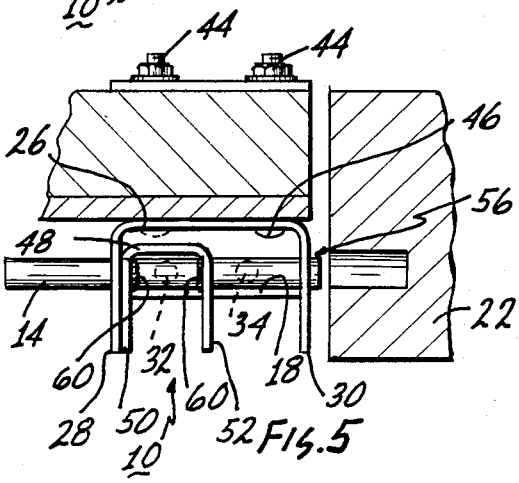
FIG. 5
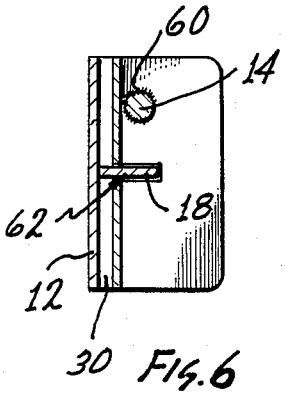
FIG. 6

PROTECTED SLIDING BOLT LOCKING STRUCTURE

BACKGROUND OF THE INVENTION

This invention is directed to a locking structure having a sliding bolt which is capable of being utilized as either a right hand or a left hand locking mechanism. Further, the locking structure is a protected locking structure wherein a lock utilized to lock the locking structure is protected against unauthorized access as, for instance, utilizing bolt cutters or the like to sever the shackle of the lock.

A variety of locking structures are known for use on doors as, for instance, garage doors. These range from easily circumvented structures such as a typical latch mechanism which slides back and forth sideways and engages a round opening in the door frame and is secured with a padlock to very sophisticated and expensive integrally formed locking mechanisms.

A garage door secured with a typical latch mechanism and a padlock is very easily broken into by either severing the padlock with bolt cutters or prying the latch mechanism with a crowbar or the like.

While certain very sophisticated locking mechanisms overcome the disadvantages of the common latch mechanism, they are normally complicated in their operation and construction and thus expensive. This has inhibited their widespread use. Further more, since many garage doors can be locked either on their right side or their left side and since many of the complicated locking mechanisms are available in only a single "handed" orientation, i.e. either a left handed mechanism or a right handed mechanism, in certain instances, these single "handed" locking mechanisms can not be positioned on the side of the door which might be the most desirable.

Additionally, depending upon the security desired and the hinge mechanism utilized for the garage door, it is sometimes desirable to have a locking mechanism on both the right and left hand side of the door. Since many of the more complicated locking mechanisms are not available in both a right and left hand sided model this also prevents their use on both sides of a typical garage door.

While it is theoretically possible to simply rotate a "single handed" locking mechanism 180° so it can be used on the opposite side of a door, this too is not without its problems. In many instances the mechanism will not operate smoothly when oriented in an upside down orientation and/or this exposes the keyslot of a lock utilized to lock this mechanism to environmental elements such as dust, rain and the like.

BRIEF DESCRIPTION OF THE INVENTION

In view of the above it is evident that there exists a need for new and improved locking mechanisms which are both simple but yet secure in their construction and which are capable of being interchangeably used as both a left or right handed locking mechanism.

It is a broad object of this invention to provide for a new and improved locking mechanism which is universal with respect to its left or right handedness and provides for protecting of a lock utilized to lock the mechanism against unauthorized entry via the use of bolt cutters, hacksaws and the like. It is a further object of this invention to provide for a locking mechanism which is simple in its construction and engineering and therefore economical to the consumer but at the same time is securely constructed and engineered to prevent unauthorized entry to the structure on which the lock mechanism is utilized.

These and other objects as will be evident from the remainder of this specification can be advantageously achieved in a protective sliding bolt locking structure which includes a housing having a left side and a right side each of which includes a bolt hole. The housing further includes a guide means for guiding movement on the housing. The guide means is located on the housing between the left and right sides of the housing and includes at least one lock implement orifice for receiving a locking implement. A member is movably mounted on the housing in operative association with the guide means so as to be movable on the guide means between the left and right sides of the housing. A bolt fixedly mounted to the member is sized and shaped to slidably fit into and move in the bolt holes in the sides of the housing. The bolt moves in the bolt holes in conjunction with movement of the member with respect to the guide means. The movement of the bolt can be fixed to lock the locking structure by inhibiting movement of the member on the guide means by positioning a locking implement in the implement orifice.

A new and improved locking mechanism of the invention can also be advantageously achieved in a sliding bolt locking structure which has a housing wherein the housing includes a back and left and right sides integrally formed with the back. A guide element is located on the housing between the left and right sides of the housing. The guide element includes at least one lock shackle hole located in the guide element. A member has left and right side panels. The member is sized and shaped to fit in the housing between the respective sides of the housing. The left and right side panels of the member are spaced apart from each other a distance sufficient to allow positioning of a lock body between the side panels. The member includes a guide channel located in the side panels with the guide channel being sized and shaped to fit onto and slide on the guide element whereby in a first position a shackle hole in the guide element is located between the left and right side panels of the member and in a further position the same shackle hole is located exterior of one of the left or right side panels of the member. At least one of the sides of the housing is provided with a bolt hole. A bolt is fixed to the member to move with the member. The bolt is sized and shaped to project through the bolt hole and to be movable in the bolt hole between extended and retracted positions in response to movement of the member on the guide element.

Preferredly the member includes a back panel and is U shaped in cross section as is the housing. Preferredly the guide element is shaped as a plate and is located in the housing between the left and rights sides of the housing and is attached either to the back of the housing, to the left and rights sides of the housing or to all of the back and the left and right sides of the housing.

Preferredly the guide channel is formed as a guide slot to fit over the guide plate.

The back plate of the housing can include at least one fastener implement opening for receiving a fastener implement for attaching the locking structure to a door or other structure. The member can be sized and shaped with respect to the housing such that the back panel of the member is positioned forward of the back plate of the housing to define an area between the housing and the back panel of the member of sufficient size to allow placement of a fastener implement head as, for instances, a bolt head between the back panel of the member and the back of the housing to allow for unimpeded movement of the member on the housing by the fastener implement head.

Preferredly the locking structure would include first and second lock shackle holes with the bolt capable of extending out of either the left hand side of the housing or the right hand side of the housing and with the member being securable to the element plate by utilizing one or the other of the lock shackle holes.

BRIEF DESCRIPTION OF THE DRAWINGS

This invention will be better understood when taken in conjunction with the drawings wherein:

FIG. 1 is an isometric view of a locking structure of the invention;

FIG. 2 is a front elevational view showing a locking structure of the invention attached to a door as, for instance a garage door, with the locking structure shown in use in conjunction with a lock in a right hand orientation;

FIG. 3 is a view similar to FIG. 2 except that the locking structure is shown attached to the left hand side of the door and in use in a left hand orientation;

FIG. 4 is a top plan view in partial section showing the locking structure of FIG. 2 in a locked position;

FIG. 5 is a top plan view in partial section similar to FIG. 4 except the locking structure is shown in an unlocked position; and FIG. 6 is a side elevational view in partial section about the line 6—6 of FIG. 4.

This invention utilizes certain principles and/or concepts as are set forth in the claims appended to this specification. Those skilled in the locksmithing arts will realize that these principles and/or concepts are capable of being utilized with a variety of embodiments which may differ from the exact embodiment utilized for illustrative purposes herein. For this reason this invention is not to be construed as being limited solely to the illustrative embodiment, but should only be construed in view of the claims.

DETAILED DESCRIPTION OF THE INVENTION

Shown in the figures is a locking structure 10 of the invention. The locking structure 10 includes a housing 12, and a sliding bolt 14. The sliding bolt 14 is attached to a movable member 16 which slides on the housing 12 in association with a guide plate 18.

As is evident from viewing FIGS. 2 and 3, the locking structure 10 of the invention can be utilized to lock a structure as, for instance, a door 20 to a further structure as, for instance, a frame 22 both from the right hand side of the door 20 as shown in FIG. 2, or from the left hand side of the door 20 as shown in FIG. 3. To lock the door 20 to the structure 22, the locking structure 10 is utilized in conjunction with a common padlock 24.

The housing 12 is formed to include a back 26 which is integrally formed with left side 28 and right side 30. As is evident from FIGS. 3, 4 and 5 the housing 12 is essentially U shaped in cross section with the left and right sides 28 and 30 located essentially perpendicular to the back 26 and extending outwardly and forwardly from the back 26. The guide plate 18 is positioned essentially in the center of the housing 12 with respect to its vertical dimension as seen in FIGS. 2 and 3. The plate 18 extends between the left and right sides 28 and 30 of the housing and abuts against the inside of the back 26 of the housing. Preferredly the plate 18, the sides 28 and 30 and the back 26 are all mutually perpendicular to each other.

Preferredly the plate 18 is integrally attached with the remainder of the housing as, for instance, by welding it to both of the sides 28 and 30 and the back 26. In other embodiments of the invention (not numbered or shown) the plate 18 might only be fixed as, for instance, to the back 26 or to the sides 28 and 30. Further, the plate 18 could be sized such that if it was attached to the back 26 it might not extend across the total inside width between the left and right sides 28 and 30 of the housing, or if the plate 18 were attached to the left and right sides 28 and 30 but not to the back 26, it might not extend all the way back to the back 26. For added strength of the locking structure 10, however, it is preferred to have the plate 18 fit against both the back 26 and the left and right hand sides 28 and 30 and attach to at least the back or the sides or preferredly both.

As alternates to welding of the plate 18 to the back 26 and the sides 28 and 30, the plate 18 would be formed to include a plurality of projections (not shown or numbered) which fit into appropriate openings (not shown or numbered) in either the back 26 or the sides 28 and 30. Thus, if the housing 12 were bent around the plate 18 these projections would become located in the openings to fix the guide plate 18 to the housing 12.

The guide plate 18 includes first and second shackle holes shown in phantom line in FIGS. 4 and 5 and identified by the numerals 32 and 34. The shackle holes 32 and 34 are sized to accept the shackle 36 of the padlock 24.

The housing 12 includes first and second holes collectively identified by the numeral 38 in its back 26. Common attaching implements as, for instance, carriage bolts collectively identified by the numeral 40 are utilized to attach the housing 12 to the door 22. The carriage bolts 40 are passed through the holes 38 and then into appropriate holes drilled into the door 20 and secured with a back plate 42 and appropriate nuts collectively identified by the numeral 44. The heads collectively identified by the numeral 46 of the carriage bolts 40 are located against the inside surface of the back 26 of the housing 12. The holes 38 in the back 26 of the housing 12 can be positioned in a variety of placements, however, it is preferred that one be positioned in the upper right hand corner as can be seen in FIG. 3 and the other positioned in the lower left hand corner as can be seen in FIG. 2.

The member 16 is also formed in a U shape and includes a back panel 48, left side panel 50 and right side panel 52. The depth of the left and right panel 50 and 52 of the member 16 is less than the depth of the left and right sides 28 and 30 of the housing 12 such that when the front edge of the panels are aligned with the front edges of the sides of the housing the back panel 48 of the member 16 is spaced forward of the back 26 of the housing 12 defining an area between the back panel 48 of the member and the inside surface of the back 26 of the housing. The carriage bolt heads 46 are located in this area and because of spacing of the back panel 48 of the member 16 forward and away from the back 26 of the housing 12 the member 16 can slide to the left and right between the sides 28 and 30 of the housing without encountering the heads 46 of the carriage bolts 40. This allows free movement of the housing 12 back and forth to the left and the right on the guide plate 18 without any interference of the heads 46 of the carriage bolts 40.

A bolt hole 54 is formed in the left side 28 of the housing 12 and a similar bolt hole 56 is formed in the right side 30 of the housing 12. The bolt 14 is free to slide in the bolt holes 54 and 56 allowing it to freely move to the left and the right in these bolt holes 54 and 56.

The bolt 14 is attached to the member 16 by passing it through bolt holes collectively identified by the numeral 58, formed in the left and right panels 50 and 52 of the member 16. The bolt 14, however, is fixed in these bolt holes 58 by an appropriate method such as the welds, collectively identified by the numeral 60 which attach the bolt 14 to both the left and right panels 50 and 52 of the member 16. This permanently fixes the bolt 14 with respect to the member 16. Alternately, pins or other means could be used to permanently fix the bolt 14 to the member 16.

Since the bolt 14 is fixed to the member 16, the bolt is slid left and right in the bolt holes 54 and 56 in response to sliding the member 16 to the left and to the right along the guide plate 18. A slot 62 is formed completely through the back panel 48 of the member 16 dividing the back panel 48 of the member 16 into upper and lower halves. The slot 62 then extends from the back panel 48 through approximately one half of the fore—aft thickness of each of the left and right panels 50 and 52. This allows the member 16 to be fit over the guide plate 18 with the guide plate 18 appropriately positioned in the slot 62. The slot 62 serves as a guide channel or guide means in the member 16. Because the slot 62 extends approximately through one half of the fore—aft thickness of each of the left and right panels 50 and 52 of the member 16, the member 16 cannot be rotated about the bolt 14 as, for instance, rotated in a counterclockwise direction as seen in FIG. 6, which would rotate the member 16 off of the guide plate 18.

Once the member 16 is positioned on the guide plate 18 by sliding the slot 62 over the guide plate 18 and the bolt 14 is then attached to the member 16 as, for instance by the weld 60, it is impossible to remove the member 16 from the housing 12 either by rotation about the bolt 14 or by movement in any other direction.

The left and right side panels 50 and 52 of the member 16 are spaced apart one from the other across the width of the back panel 48 of the member 16 a distance sufficient to allow location of the padlock 24 in between the right and left panels 50 and 52. As seen in FIG. 4, when the member 16 and the bolt 14 attached thereto are slid all the way to the right such that the right panel 52 of the member 16 abuts against the inside of the right side 30 of the housing, the shackle hole 34 is positioned in the center of the left and right panels 50 and 52 of the member 16. If the shackle 36 of the padlock 24 is now passed through the shackle hole 34 and the padlock 24 locked, the member 16 cannot freely slide across the guide plate 18 because in moving to the left, as seen in FIG. 4, the right panel 52 of the member 16 contacts the padlock 24. This prevents further movement to he right of the member 16 along the guide plate 18.

In a similar manner, when the member 16 is positioned as seen in FIG. 5, the left side shackle hole 32 is centered between the left panel 50 and right panel 52 of the member 16. If, as seen in FIG. 3, the shackle 36 of the padlock 24 is now passed through the shackle hole 32, the member 16 becomes locked in a left hand position because the presence of the padlock 24 between t left and right panels 50 and 52 prevent the member from being slid to the right along the guide plate 18.

The bolt 14 of the locking structure 10 is thus lock in either a left hand configuration, as seen in FIGS. and 5, or a right hand configuration, as seen in FIGS and 4, by positioning the member 16 either to the left the housing 12 or to the right in the housing 12 a passing the shackle 36 of the padlock 24 through t appropriate shackle hole 32 or 34. The presence of t padlock 24 prevents movement of the member 16 on t guide plate 18.

It is also evident from FIG. 6 that the padlock could also be locked through the shackle hole 32. Tl also would prevent the member 16 from being slid the left as seen in FIG. 4, however, it is preferred position the padlock in between the left and right pan 50 and 52 when locking the locking structure 10 in a particular configuration for the following reason.

The left and right panels 50 and 52, while bei spaced apart from one another a sufficient distance allow positioning of the padlock 24 between them not spaced apart from one another a sufficient distar to allow the head of the bolt cutter in an opened orien tion to be slid between them in an attempt to sever shackle 36 of the padlock 24. Additionally, as can seen from FIGS. 2, 3 and 4, the totality of the shackle of the padlock 24 is positioned in between the left a right panels 50 and 52 of the member 16 and thus is exposed wherein it could be severed with a hacksaw the like.

The lock 16 while being capable of being locked w a common padlock 24, provides a secure environm for the padlock 24 and protects the padlock 24 agai severing from either bolt cutters, hacksaws or the like provide for securely locking of the lock structure and the door 20 to which it is attached to the struct 22. It is also evident that depending on the position the member 16 in the housing 12, at any one instan while one or the other of the carriage bolt heads 4 exposed, the other one is hidden and is protected by member 16. Thus, even if one attempts to use a cutter the like to sever the exposed carriage head bolt, other one is protected and the locking structure cannot be removed from the door 20 from the outsi As is evident from FIGS. 2, 3, 4 and 5, the lock structure 10 is universal in its application as eithe right hand locking structure or a left hand lock structure. Further, the locking structure 10 can locked in an open configuration as, for instance, if it used for a right hand locking structure as seen in FI 4 and 5 and was locked in the position as seen in FIG Because of the construction of the device 10, all the components are capable of being formed from propriate materials such as tool steel, chromium steel the like which can be case hardened or the like to m them more invulnerable to attempted tampering.

What is claimed is:

1. A protected sliding bolt locking structure wh comprises:

a housing;

said housing including a left side and a right side, e of said respective sides including a bolt hole in side;

said housing further including a guide plate for g ing movement on said housing, said guide p located on said housing between said left side said right side, said guide plate including at l one lock implement orifice for receiving a locking implement;

a member movably mounted on the housing in operative association with said guide plate, said member movable on said guide plate between said left and right sides;

a guide slot located in said member, said guide plate slidably fitting into said guide slot whereby said member is movably guided on said guide plate; and a bolt fixedly mounted to said member and sized and shaped to slidably fit into and move in said bolt holes in said respective left and right sides, said bolt moving with respect to said bolt holes in said respective sides in conjunction with movement of said member with respect to said guide plate and said bolt essentially fixed with respect to movement in said respective bolt holes in response to inhibiting movement of said member on said guide plate, movement of said member on said guide plate inhibited by positioning a locking implement in said implement orifice.

2. A locking structure of claim 1 wherein:

said housing includes a back plate and each of said left and right sides comprises a side plate integrally attached to said back plate and extending essentially outwardly from said back plate.

3. A locking structure of claim 1 wherein:

said member includes a member back panel, a member left side panel and a member right side panel, said member left and right side panels integrally attached to said member back panel and extending essentially outwardly from said back panel.

4. A locking structure of claim 3 wherein:

said bolt comprises an elongated bolt of a length greater than the distance between said left and right sides of said housing; and said member left and right side panels each including a panel bolt hole, said bolt fixedly fitting in said panel bolt holes and located on said member in a position such that a first portion of said bolt extends outwardly beyond said member left side panel and a further portion of said bolt extends outwardly beyond said member right side panel.

5. A locking structure of claim 2 including:

said guide plate extending on said housing between said left and right side plates;

said left and right side plates located essentially perpendicular to said back plate and essentially parallel to each other; and said guide plate located essentially perpendicular to both said back plate and said left and right side plates whereby said left and right side plates, said back plate and said guide plate are located mutually perpendicular to each other.

6. A locking structure of claim 5 wherein:

said member includes a member back panel, a member left side panel and a member right side panel, said member left and right side panels integrally attached to said member back panel and extending essentially outwardly from said back panel;

said guide slot formed in part in said member back panel and in part in said member left and right side panels; and said member fitting over said guide plate with said guide plate fitting into said guide slot.

7. A locking structure of claim 6 wherein:

said guide slot extends through a portion of each of said left and right side panels from said member back panel in a direction outwardly from said back panel.

8. A locking structure of claim 7 wherein:

said bolt comprises an elongated bolt of a length greater than the distance between said left and right sides of said housing; and said member left and right side panels each including a panel bolt hole, said bolt fixedly fitting in said panel bolt holes and located on said member in a position such that a first portion of said bolt extends outwardly beyond said member left side panel and a further portion of said bolt extends outwardly beyond said member right side panel.

9. A sliding bolt locking structure which comprises:

a housing, said housing including a back and left and right sides integrally formed with said back;

a guide element located on said housing between said left and right sides, said guide element including at least one lock shackle hole located in said guide element;

a member having left and right side panels, said member sized and shaped to fit in said housing between said respective sides of said housing, said left and right side panels spaced apart from each other a distance sufficient to allow positioning of a lock body between said respective side panels;

said member including a guide channel located in said side panels, said guide channel sized and shaped to fit onto and slide on said guide element whereby in a first position said shackle hole in said guide element is located between said left and right side panels of said member and in a further position said shackle hole is located exterior of one of said left or right side panels of said member;

at least one of said respective sides of said housing including a bolt hole; and a bolt fixed to said member to move with said member, said bolt sized and shaped to project through said bolt hole in said one of said respective sides of said housing and to be movable in said bolt hole between extended and retracted positions in response to movement of said member on said guide element.

10. A locking structure of claim 9 wherein:

said member is U shaped in cross section;

said member includes a back integrally formed with said side panels; and said housing is U shaped in cross section.

11. A locking structure of claim 9 wherein:

said guide element is attached to one of said back or said left and right sides to fixedly hold said guide element on said housing.

12. A locking structure of claim 9 wherein:

each of said left and said right sides of said housing include a bolt hole; and said bolt sized and shaped to extend across said housing and to project through said bolt holes in both of said left and right sides of said housing, said bolt movable with respect to both of said sides of said housing between extended positions and retracted positions in response to movement of said member on said guide element.

13. A locking structure of claim 9 wherein:

said guide channel comprises a guide slot formed in said side panels of said member; and said guide member comprises a guide plate positioned on said housing to fit into said guide slot.

14. A locking structure of claim 13 wherein:

said guide plate is fixedly attached to at least said respective sides of said housing or said back of said housing to fixedly hold said plate on said housing.

15. A locking structure of claim 10 wherein:

said back of said housing including at least one fastener implement opening; and .

said member is sized and shaped with respect to said housing such that said back panel of said member is positioned forward of said back of said housing to define an area between said back of said housing and said back panel of said member, said area of size sufficient to allow placement of a fastener implement head between said back panel of said member and said back of said housing with the remainder of said fastener implement extending out of said fastener implement opening beyond said back of said housing.

16. A locking structure of claim 9 wherein:

said guide element includes first and second shackle holes, one of said shackle holes located to the left of the center of said housing and the other of said shackle holes located to the right of center of said housing.

17. A locking structure of claim 16 wherein:

each of said left and said right sides of said housing include a bolt hole;

said bolt sized and shaped to extend across said housing and to project through said bolt holes in both of said left and right sides of said housing, said bolt movable with respect to both of said sides of said housing between extended positions and retracted positions in response to movement of said member on said guide element; and said bolt capable of being locked in an extended position with respect to said left side of said housing by positioning a lock body between the respective side panels of said member with the shackle of said lock in said shackle hole on said left side of center of said housing and said bolt capable of being locked in a extended position with respect to said right side of said housing by positioning a lock body between the respective side panels of said housing with the shackle of said lock in said shackle hole on said right side of center of said housing.

18. A locking structure of claim 17 wherein:

said guide channel comprises a guide slot formed in said side panels of said member;

said guide member comprises a guide plate positioned on said housing to fit into said guide slot; and said guide plate is fixedly attached to at least said respective sides of said housing or said back of said housing to fixedly hold said plate on said housing.

* * * * *